US009555626B1

(12) United States Patent
Aiba et al.

(10) Patent No.: US 9,555,626 B1
(45) Date of Patent: Jan. 31, 2017

(54) PRINTER PROVIDED WITH HEAD UNITS HAVING DIFFERENCES IN EJECTION PERFORMANCE AND METHOD OF MANUFACTURING PRINTER

(71) Applicant: Brother Kogyo Kabushiki Kaisha, Nagoya-shi, Aichi-ken (JP)

(72) Inventors: Takashi Aiba, Nagoya (JP); Shohei Koide, Nagoya (JP); Keita Sugiura, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/082,873

(22) Filed: Mar. 28, 2016

(30) Foreign Application Priority Data

Sep. 30, 2015 (JP) ..... 2015-192678

(51) Int. Cl.
*B41J 29/38* (2006.01)
*B41J 2/045* (2006.01)
*B41J 2/16* (2006.01)

(52) U.S. Cl.
CPC ..... *B41J 2/04541* (2013.01); *B41J 2/04586* (2013.01); *B41J 2/162* (2013.01); *B41J 2/1632* (2013.01)

(58) Field of Classification Search
CPC . B41J 2/04506; B41J 2/04513; B41J 2/04588; B41J 2/155; B41J 2/515; B41J 2202/20; B41J 2202/21
See application file for complete search history.

(56) References Cited

U.S. PATENT DOCUMENTS 8,608,283 B1 12/2013 Phillips et al.
2009/0066743 A1 3/2009 Komatsu et al.
2010/0220152 A1 9/2010 Hayashi

FOREIGN PATENT DOCUMENTS

EP 1623829 A1 * 2/2006 ..... B41J 2/04581
JP 2010-201730 A 9/2010

OTHER PUBLICATIONS

Mar. 28, 2016—Co-pending U.S. Appl. No. 15/082,828.
Sep. 9, 2016—Notice of Allowance—U.S. Appl. No. 15/082,828.

* cited by examiner

*Primary Examiner* — Julian Huffman
(74) *Attorney, Agent, or Firm* — Banner & Witcoff, Ltd.

(57) ABSTRACT

An inkjet head includes a plurality of head units including a first head unit and a second head unit. Each head unit has a plurality of nozzles and a plurality of drive elements. The second head unit has an ejection performance of nozzles lower than an ejection performance of nozzles of the first head unit. The second head unit is farther from a center portion of the inkjet head than the first head unit is. A drive unit is configured to apply a drive voltage for generating energy to each of the plurality of drive elements included in each of the plurality of head units. The drive voltage applied to each of the plurality of drive elements included in the first head unit is lower than the drive voltage applied to each of the plurality of drive elements included in the second head unit.

10 Claims, 11 Drawing Sheets

PRINTER PROVIDED WITH HEAD UNITS HAVING DIFFERENCES IN EJECTION PERFORMANCE AND METHOD OF MANUFACTURING PRINTER

CROSS REFERENCE TO RELATED APPLICATION

This application claims priority from Japanese Patent Application No. 2015-192678 filed Sep. 30, 2015. The entire content of the priority application is incorporated herein by reference. The present application is closely related to a co-pending U.S. Patent Application (corresponding to Japanese Patent Application No. 2015-192677 filed Sep. 30, 2015).

TECHNICAL FIELD

The present disclosure relates to a printer and a method of manufacturing the printer.

BACKGROUND

A conventional inkjet printer prints images by ejecting ink droplets onto a recording medium being conveyed in a prescribed direction. The conventional printer is equipped with a line-type inkjet head having a plurality of nozzles aligned in a width direction of the recording medium.

More specifically, the inkjet head has a plurality of head units (head modules) arranged in two rows that extend in the width direction of the recording medium (direction of alignment). The positions of the head units in the two unit rows are shifted from each other in the direction of alignment. Further, the layout range of nozzles in a head unit belonging to one unit row partially overlaps the layout range of nozzles in a head unit belonging to the other unit row in the conveying direction of the recording medium. Note that the head units constituting a single unit row are arranged at equal intervals in the alignment direction. Thus, any two head units of different unit rows that overlap in the conveying direction have the same amount of overlap regardless of the positions of the head units in the alignment direction.

Each head unit has a plurality of channel modules in which are formed nozzles and pressure chambers, and a plurality of actuator modules having piezoelectric elements corresponding to the pressure chambers in the channel modules. Each piezoelectric element in the actuator module has a piezoelectric layer, and two types of electrodes disposed one on either side of the piezoelectric layer. The piezoelectric element utilizes deformation generated in the piezoelectric layer (piezoelectric strain) when a prescribed drive voltage is applied across the two types of electrodes to generate a pressure wave in the corresponding pressure chamber of the channel module in order to eject ink from the corresponding nozzle.

The following method of assembling an inkjet head has also been employed in order to suppress variations in ink temperature among inkjet heads. First, the capacitance of each actuator module is measured, and the modules are ranked based on the magnitude of their capacitance. When assembling the inkjet heads, the modules are arranged according to their assigned ranks. Specifically, modules having a high capacitance generate a greater amount of heat than modules with low capacitance. Therefore, modules having high capacitance are arranged at end positions that are more easily cooled, while modules having low capacitance are arranged at center positions less conducive to cooling.

SUMMARY

In the majority of printing jobs performed on a line printer, print text, images, and the like are printed on the widthwise center region of a recording medium, while printing on the widthwise edges of a recording medium is less common. Therefore, it stands to reason that head units in the inkjet head ejecting ink droplets toward the widthwise center region of the recording medium are used more frequently than head units ejecting ink droplets toward the widthwise edge regions on the recording medium.

It is known that the properties of the piezoelectric layers in each head unit degrade as drive voltages are repeatedly applied to the piezoelectric elements in the actuator module, leading to a gradual decline in the performance of the piezoelectric elements. Since voltage is applied more frequently across piezoelectric elements in head units that print the widthwise center region of the recording medium than in head units that print the widthwise edge regions, these piezoelectric elements will degrade more quickly. Consequently, the piezoelectric elements in head units used for the center region may degrade to the point of being unusable while piezoelectric elements in head units used for the edge regions still function sufficiently well. This is undesirable, as the service life of the overall product is shortened by the elements that degrade most rapidly. If the higher drive voltage is applied to the piezoelectric element that has been degraded, efficiency or performance of the piezoelectric element can be maintained. However, there is a limit on increase in the drive voltage. Accordingly, the efficiency or performance of the piezoelectric element cannot be restored after the drive voltage reaches the maximum value.

In view of the foregoing, it is an object of the present disclosure to provide a printer that can suppress a reduction in product life caused by degradation of driving elements in the head units used with highest frequency.

In order to attain the above and other objects, the disclosure provides a printer including a conveying unit, an inkjet head, and a drive unit. The conveying unit is configured to convey a recording medium in a conveying direction. The inkjet head includes a plurality of head units arranged in an alignment direction crossing the conveying direction. The inkjet head has end portions and a center portion between the end portions in the alignment direction. Each of the plurality of head units has a plurality of nozzles and a plurality of drive elements. The plurality of nozzles and the plurality of drive elements have a one-to-one correspondence. Each of the plurality of drive elements is configured to apply ejecting energy to ink to eject an ink droplet through corresponding one of the plurality of nozzles. The plurality of head units includes a first head unit and a second head unit. The second head unit has an ejection performance of nozzles lower than an ejection performance of nozzles of the first head unit. The second head unit is farther from the center portion than the first head unit is. The drive unit is configured to apply a drive voltage for generating the ejecting energy to each of the plurality of drive elements included in each of the plurality of head units. The drive voltage applied to each of the plurality of drive elements included in the first head unit is lower than the drive voltage applied to each of the plurality of drive elements included in the second head unit.

According to another aspect, the present disclosure provides a printer including a conveying unit, a first inkjet head, a second inkjet head, and a drive unit. The conveying unit is configured to convey a recording medium in a conveying direction. The first inkjet head is configure to eject first ink on the recording medium. The second inkjet head is configured to eject second ink on the recording medium. The first inkjet head and the second inkjet head are arranged in the conveying direction. Each of the first inkjet head and the second inkjet head has a plurality of head units arranged in an alignment direction crossing the conveying direction. Each of the plurality of head units has a plurality of nozzles and a plurality of drive elements. The plurality of nozzles and the plurality of drive elements have a one-to-one correspondence. Each of the plurality of drive elements is configured to apply ejecting energy to ink to eject an ink droplet from corresponding one of the plurality of nozzles. Each of the plurality of head units of the second inkjet head has an ejection performance of nozzles lower than an ejection performance of nozzles of each of the plurality of head units of the first head unit. The drive unit is configured to apply a drive voltage for generating the ejecting energy to each of the plurality of drive elements included in each of the plurality of head units. The drive voltage applied to each of the plurality of drive elements included in each of the plurality of head units of the first inkjet head is lower than the drive voltage applied to each of the plurality of drive elements included in each of the plurality of head units of the second inkjet head.

According to another aspect, the present disclosure provides a method of manufacturing a printer including: manufacturing a plurality of head units each having a plurality of nozzles and a plurality of drive elements, the plurality of nozzles and the plurality of drive elements having a one-to-one correspondence, each of the plurality of drive elements being configured to apply ejecting energy to ink to eject an ink droplet from corresponding one of the plurality of nozzles; measuring an ejection performance of nozzles of each of the plurality of head units; and assembling an inkjet head by arranging the plurality of head units in a predetermined direction, the plurality of head units including a first head unit and a second head unit, the second head unit having an ejection performance of nozzles lower than an ejection performance of nozzles of the first head unit, wherein the second head unit is farther from a center portion of the inkjet head than the first head unit is.

According to another aspect, the present disclosure provides a method of manufacturing a printer including: manufacturing a plurality of head units each having a plurality of nozzles and a plurality of drive elements, the plurality of nozzles and the plurality of drive elements having a one-to-one correspondence, each of the plurality of drive elements being configured to apply ejecting energy to ink to eject an ink droplet from corresponding one of the plurality of nozzles; measuring an ejection performance of nozzles of each of the plurality of head units; and assembling a first inkjet head configured to eject first ink and a second inkjet head configured to eject second ink, the first inkjet head being assembled by arranging first head units of the plurality of head units in a predetermined direction, the second inkjet head being assembled by arranging second head units of the plurality of head units in the predetermined direction, each of the second head units having an ejection performance of nozzles lower than an ejection performance of nozzles of each of the first head units.

BRIEF DESCRIPTION OF THE DRAWINGS

The particular features and advantages of the disclosure as well as other objects will become apparent from the following description taken in connection with the accompanying drawings, in which.

DETAILED DESCRIPTION

First Embodiment

Next, an inkjet printer according to a first embodiment will be described. The inkjet printer is configured to print images by ejecting ink droplets from nozzles onto recording paper.

Figure 1:
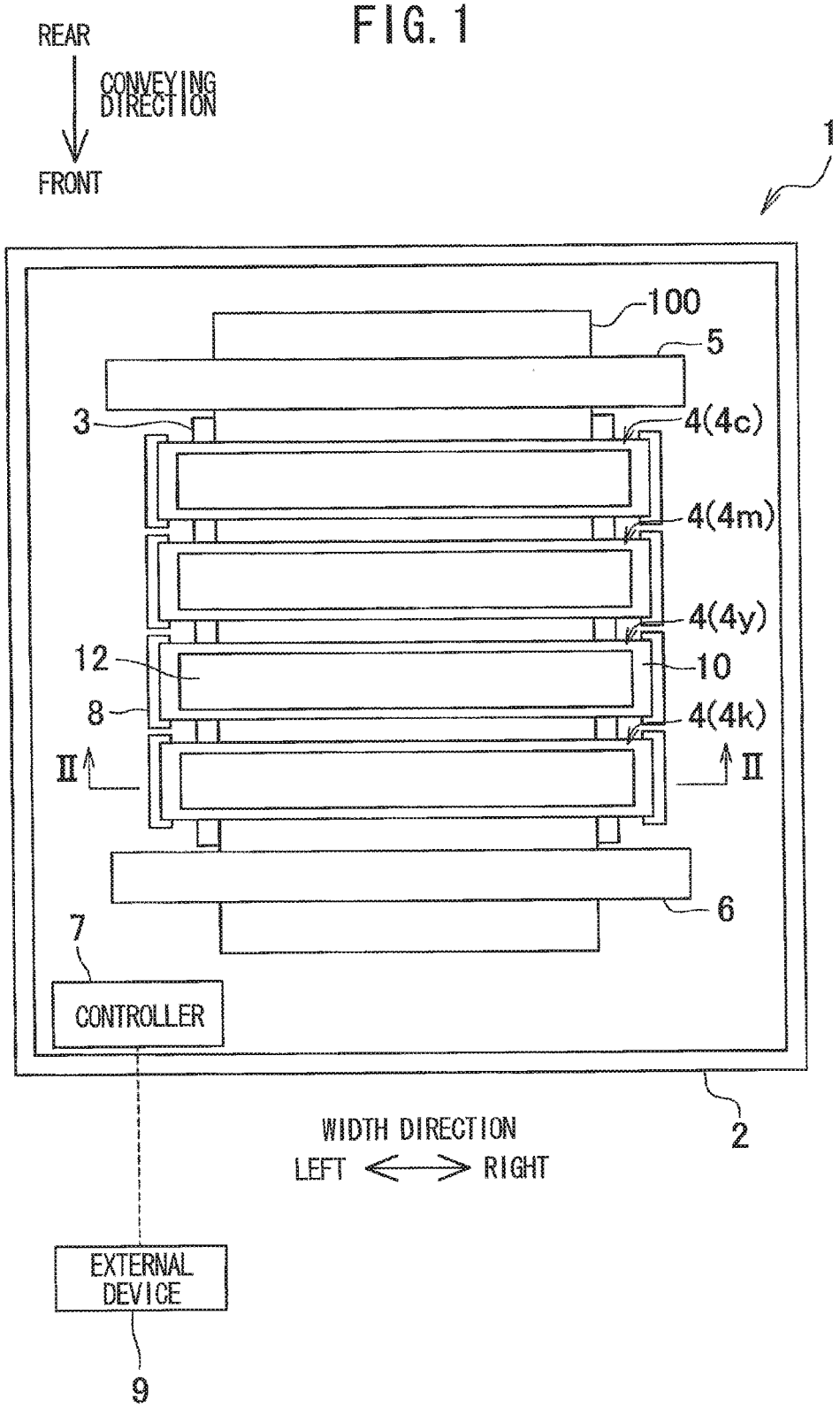
FIG. 1 is a plan view of a printer according to a first embodiment.

FIG. 1 shows a printer 1 and a sheet 100 conveyed in the printer 1. The downstream side of the sheet 100 in the conveying direction will be defined as the side nearest the front of the printer 1, while the upstream side will be defined as the side nearest the rear of the printer 1. The width direction of the sheet 100 orthogonal to the conveying direction and parallel to the plane through which the sheet 100 is conveyed (a plane parallel to the paper surface of FIG. 1) will be defined as the left-right direction of the printer 1. Here, the left side of FIG. 1 corresponds to the left side of the printer 1, and the right side of FIG. 1 corresponds to the right side of the printer 1. The vertical (up-down) direction of the printer 1 is defined as the direction orthogonal to the plane through which the sheet 100 is conveyed (the direction orthogonal to the paper surface of FIG. 1). Further, the near side in FIG. 1 corresponds to the top of the printer 1, while the far side corresponds to the bottom. The following description will use directional terms such as front, rear, left, right, up, and down as is appropriate.

Overall Structure of Printer

Figure 2:
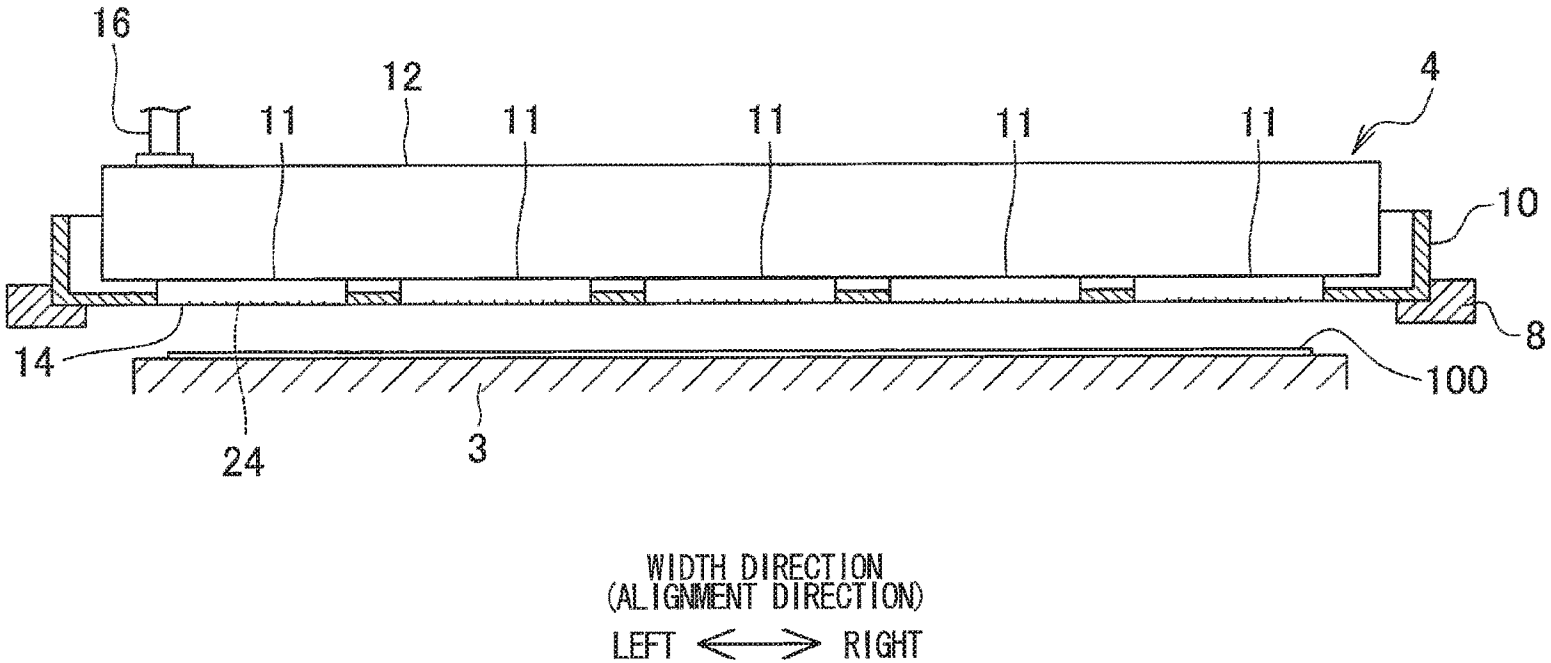
FIG. 2 is a cross-sectional view along a line II-II shown in FIG. 1.

As shown in FIGS. 1 and 2, the printer 1 includes an enclosure 2 that accommodates a platen 3, four inkjet heads 4, two conveying rollers 5 and 6, and a controller 7.

When conveyed through the printer 1, the sheet 100 is supported on the top surface of the platen 3. The four inkjet heads 4 (4*c*, 4*m*, 4*y*, and 4*k*) are arranged in order in the conveying direction above the platen 3. The conveying roller 5 is disposed on the rear side of the platen 3 (upstream side in the conveying direction), while the conveying roller 6 is disposed on the front side of the platen 3 (downstream side). A motor (not shown) is provided for driving the conveying rollers 5 and 6 to rotate in order to convey the sheet 100 forward over the platen 3.

The controller 7 includes a central processing unit (CPU), a read-only memory (ROM), a random access memory (RAM), a nonvolatile memory such as electrically erasable programmable read-only memory (EEPROM), and an application-specific integrated circuit (ASIC) that includes various control circuits. The controller 7 is also connected to a personal computer or other external device 9 and is capable of performing data communications with the same. The controller 7 is configured to control the components of the printer 1 on the basis of print data transmitted from the external device 9.

More specifically, the controller 7 is configured to control the motor that drives the conveying rollers 5 and 6 so that the conveying rollers 5 and 6 convey the sheet 100 in the conveying direction, and is configured to control the inkjet heads 4 to eject ink on the sheet 100 as the sheet 100 is conveyed. Through this operation, the printer 1 prints an image on the sheet 100.

Structure of Inkjet Heads

Figure 3:
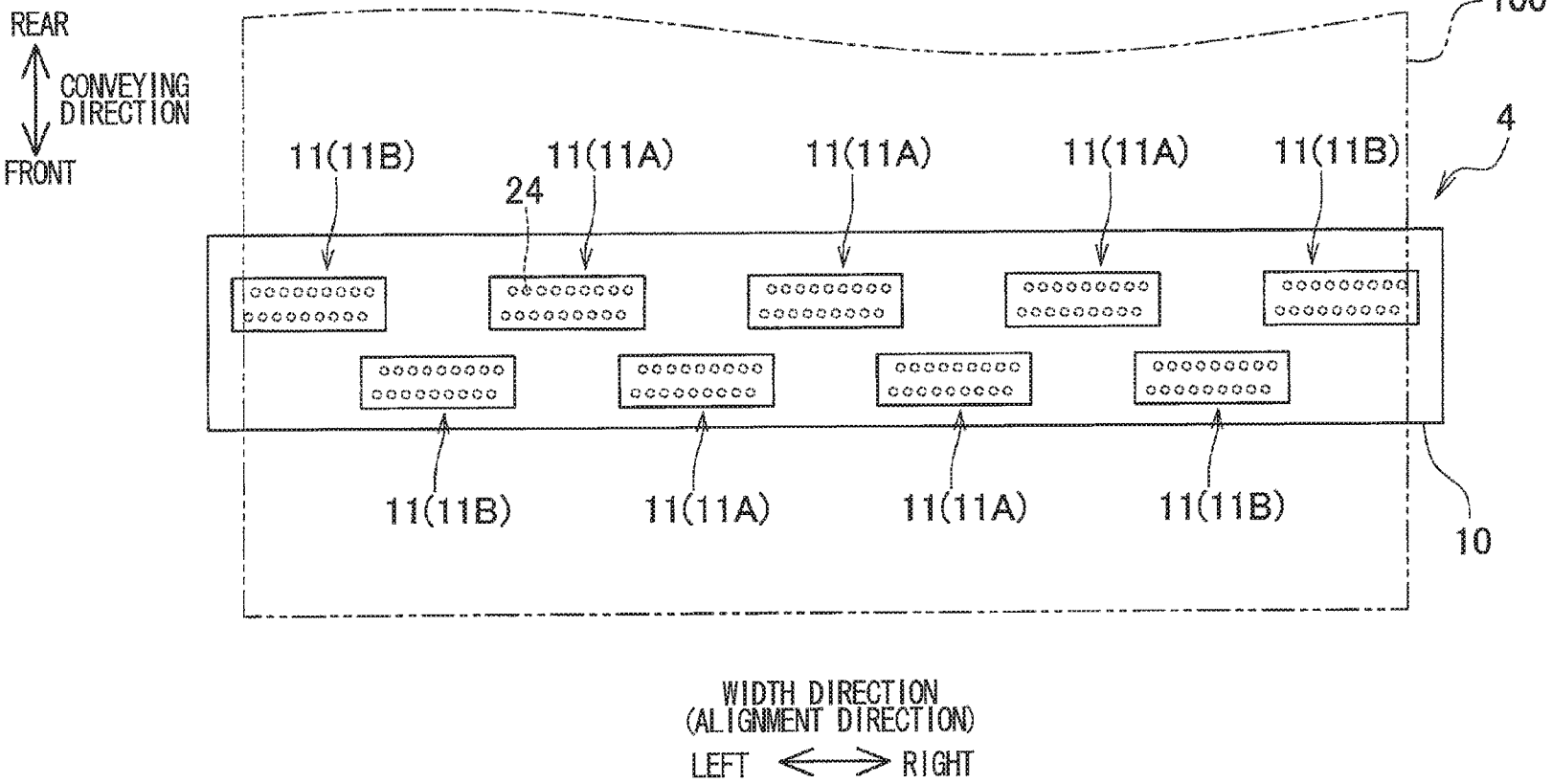
FIG. 3 is a plan view of an inkjet head of the printer according to the first embodiment.

Next, the structure of the inkjet heads 4 will be described in greater detail. As shown in FIGS. 1 to 3, four head-retaining units 8 are mounted in the enclosure 2. The head-retaining units 8 are juxtaposed in the front-rear direction and are positioned above the platen 3 and between the conveying rollers 5 and 6. The four inkjet heads 4 are respectively retained in the four head-retaining units 8.

The inkjet heads 4 (4*c*, 4*m*, 4*y*, and 4*k*) serve to eject ink in their respective colors cyan (C), magenta (M), yellow (Y), and black (K). Ink tanks (not shown) are provided to supply ink in the corresponding colors to the four inkjet heads 4.

The inkjet heads 4 all have the same structure. As shown in FIGS. 2 and 3, each inkjet head 4 includes a holder 10 having a rectangular plate shape elongated in the width direction of the sheet 100, and a plurality (nine in the first embodiment) of head units 11 mounted in the holder 10.

The bottom surface of each head unit 11 constitutes an ink ejection surface 14. Ejection holes for a plurality of nozzles 24 are formed in each ink ejection surface 14. The nozzles 24 in each head unit 11 are arranged in two rows, with the nozzles 24 in each row being aligned along the longitudinal dimension of the inkjet head 4 corresponding to the width direction of the sheet 100 (hereinafter called the "direction of nozzle alignment" or "nozzle alignment direction"). The head units 11 will be described later in greater detail.

The nine head units 11 are juxtaposed in the nozzle alignment direction and are alternately staggered to the front side and rear side relative to the conveying direction so that four of the head units 11 are positioned closer to the front side and five closer to the rear side. The left-right positions of the four head units 11 on the front side (positions of the head units 11 relative to the nozzle alignment direction) are offset from the left-right positions of the five head units 11 on the rear side. That is, the nine head units 11 are arranged in a staggered formation in the nozzle alignment direction and configure two unit rows that will be called a front unit row and a rear unit row. The front unit row includes four head units, while the rear unit row includes five head units. In the first embodiment, the head units 11 are aligned in a direction that is orthogonal to the conveying direction and that corresponds to the width dimension of the sheet 100, but the head units 11 may be aligned in a direction intersecting or crossing the conveying direction by an angle of 90 degrees or greater, i.e., along a slope to the conveying direction.

As shown in FIGS. 1 and 2, each inkjet head 4 has a reservoir 12 arranged above the nine head units 11. Note that the reservoir 12 has been omitted from the drawing of FIG. 3. The reservoir 12 is connected to an ink tank (not shown) by a tube 16. The reservoir 12 temporarily stores ink supplied from the ink tank. The bottom portion of the reservoir 12 is connected to each of the nine head units 11 and supplies ink thereto.

Detailed Description of Head Units

Figure 4:
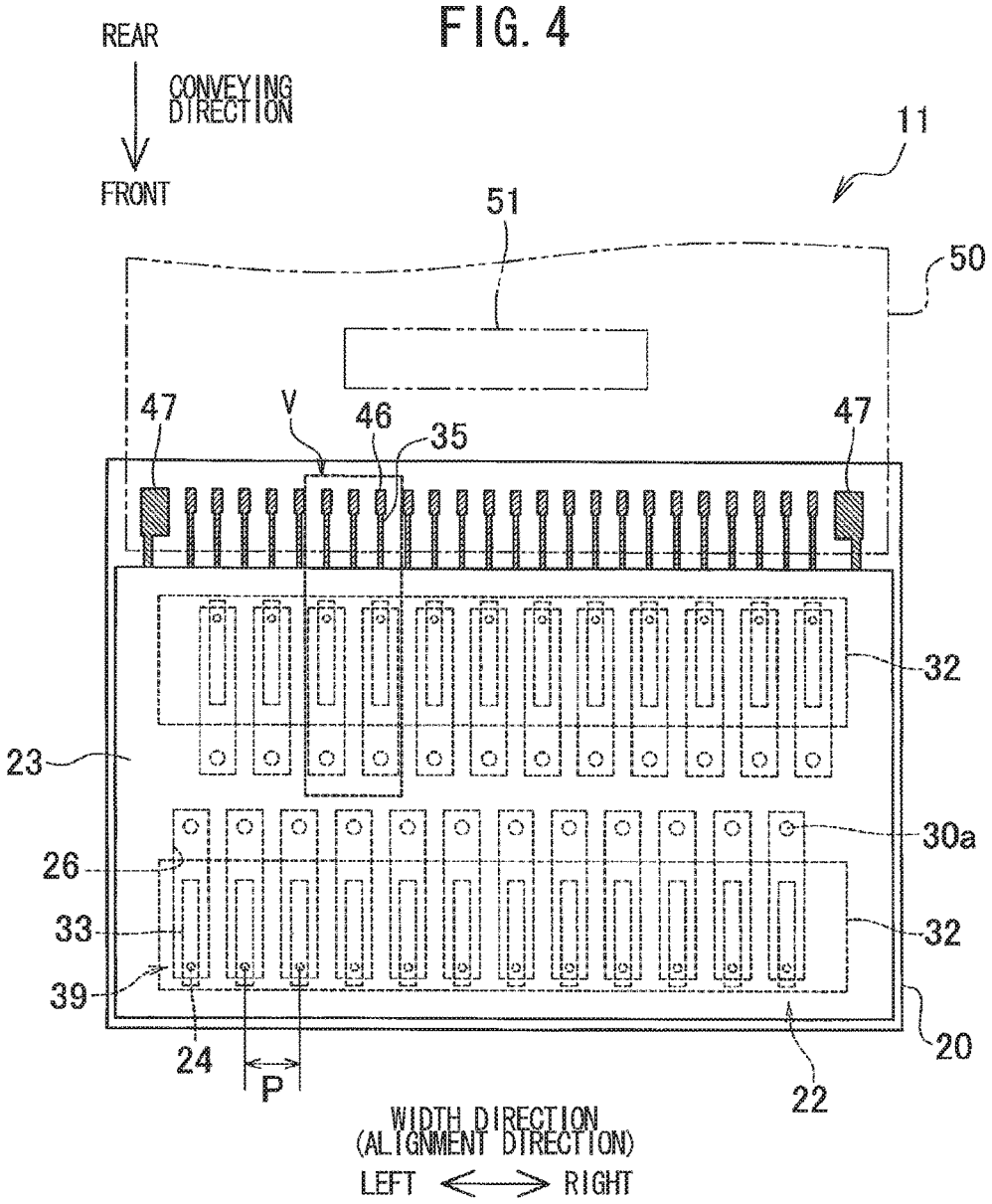
FIG. 4 is a plan view of a head unit included in the inkjet head shown in FIG. 3.
Figure 5:
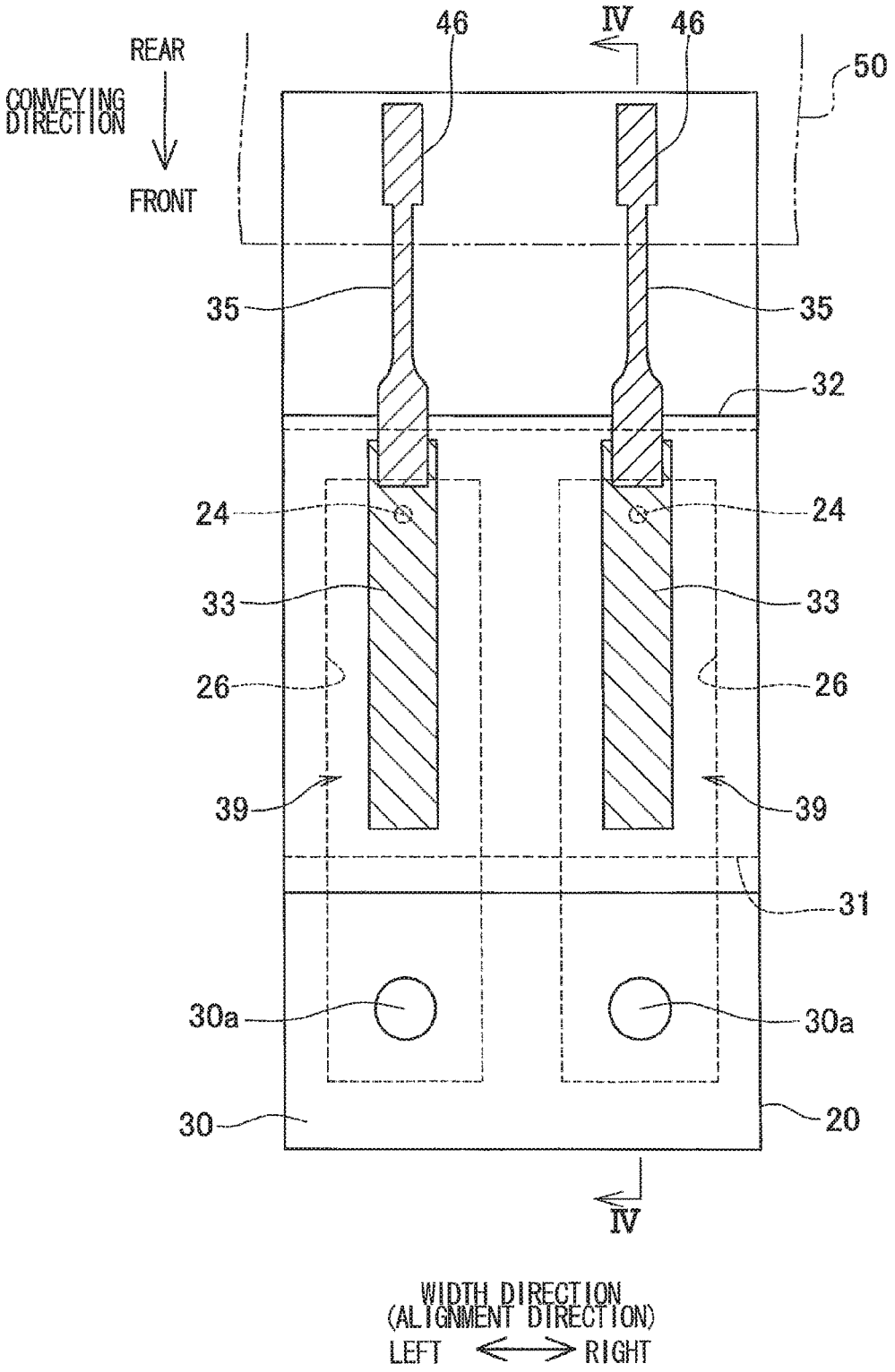
FIG. 5 is an enlarged view of a portion V shown in FIG. 4.
Figure 6:
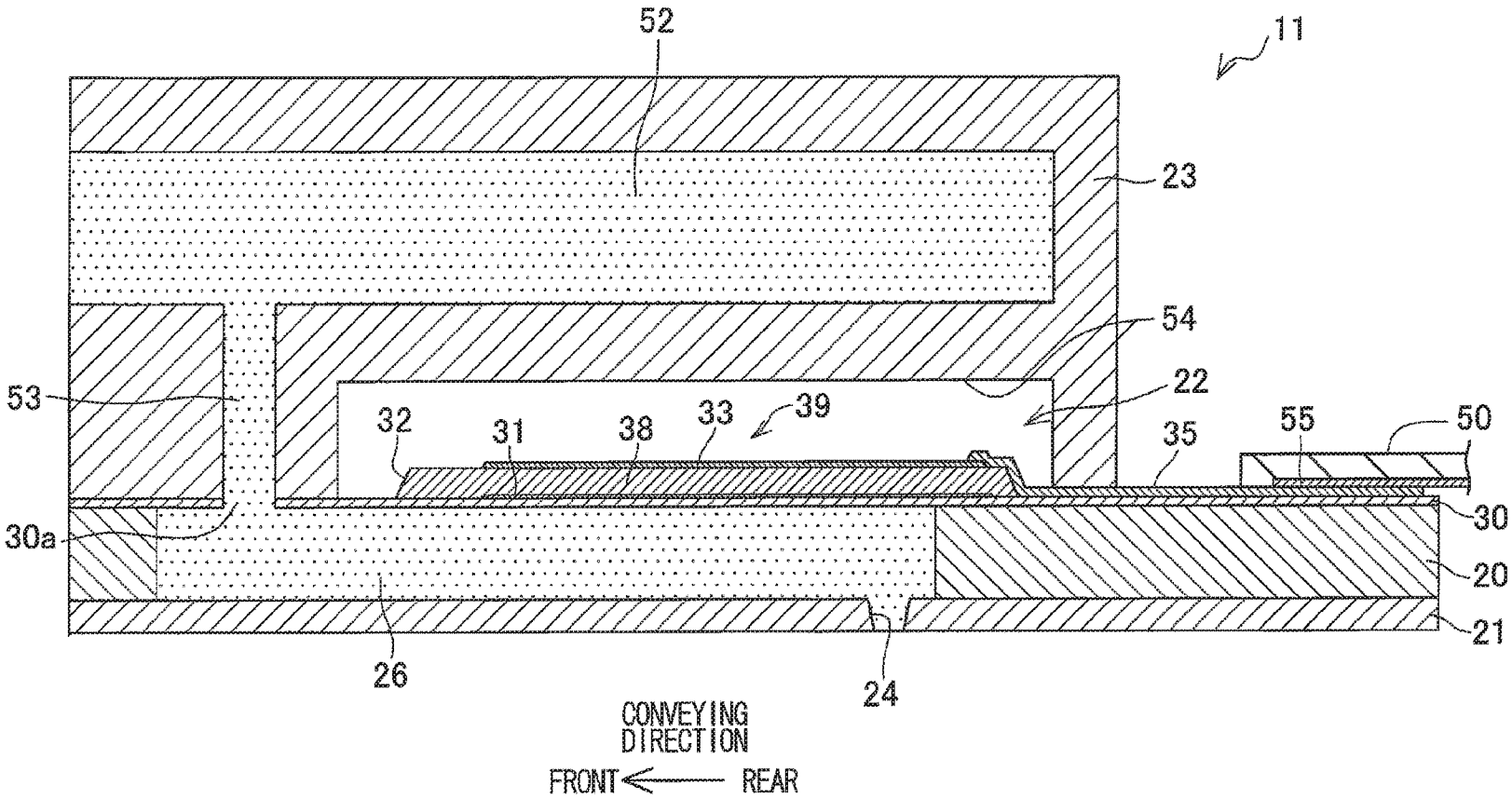
FIG. 6 is a cross-sectional view along a line VI-VI shown in FIG. 5.

Next, the head units 11 will be described in greater detail. As shown in FIGS. 4-6, each head unit 11 includes a channel substrate 20, a nozzle plate 21, a piezoelectric actuator 22, a cover member 23, and an interconnection member configured of a chip-on-film (COF) 50. Note that the cover member 23 positioned above the piezoelectric actuator 22 has been omitted from FIG. 5 to facilitate understanding of the structure of the piezoelectric actuator 22.

Channel Substrate

The channel substrate 20 is a monocrystalline silicon substrate. A plurality of pressure chambers 26 is formed in the channel substrate 20. The pressure chambers 26 have a rectangular shape with the long side extending in the conveying direction. As shown in FIG. 4, the pressure chambers 26 are juxtaposed in the alignment direction corresponding to the width direction of the sheet 100 and are configured of two pressure chamber rows juxtaposed in the conveying direction. A diaphragm 30 is formed on the channel substrate 20 for covering the plurality of pressure chambers 26. The diaphragm 30 is a membrane that includes silicon dioxide ($SiO_2$) or silicon nitride ($SiN_x$) formed by partially oxidizing or nitriding the surface of the silicon channel substrate 20. Through-holes 30*a* are formed in the diaphragm 30 at positions overlapping inner ends of the corresponding pressure chambers 26.

Nozzle Plate

The nozzle plate 21 is bonded to the bottom surface of the channel substrate 20. A plurality of the nozzles 24 is formed in the nozzle plate 21. The nozzles 24 respectively communicate with the plurality of pressure chambers 26 formed in the channel substrate 20. As shown in FIG. 4, the nozzles 24 are arranged to overlap the outer ends of the corresponding pressure chambers 26. In other words, the nozzles 24 are arranged in the nozzle alignment direction corresponding to the width dimension of the sheet 100 at positions corresponding to the pressure chambers 26 and constitute the two nozzle rows that are juxtaposed in the conveying direction. The positions of the nozzles 24 in different nozzle rows are offset from each other in the nozzle alignment direction by half the alignment pitch P of nozzles (P/2) in a single nozzle row. While there is no particular restriction on the material of the nozzle plate 21, the nozzle plate 21 may be a monocrystalline silicon substrate like the channel substrate 20. Alternatively, the nozzle plate 21 may be formed of a synthetic resin material.

Piezoelectric Actuator

The piezoelectric actuator 22 applies ejecting energy to ink in the plurality of pressure chambers 26 in order to eject ink droplets from the corresponding nozzles 24. As shown in FIGS. 4 through 6, each piezoelectric actuator 22 is provided with a plurality of piezoelectric elements 39 arranged on the top surface of the diaphragm 30 at positions corresponding to the pressure chambers 26.

Here, the structure of the piezoelectric elements 39 will be described. In the first embodiment, the piezoelectric elements 39 are formed on the top surface of the diaphragm 30 through sequential deposition of a plurality of thin films, including a film constituting a lower electrode 31, films constituting piezoelectric layers 32, and films constituting upper electrodes 33.

The lower electrode 31 is formed over the top surface of the diaphragm 30, extending across the plurality of pressure chambers 26 in the nozzle alignment direction. The lower electrode 31 is a common electrode for the plurality of piezoelectric elements 39. While there is no particular restriction on the material of the lower electrode 31, the lower electrode 31 may be formed of platinum (Pt), for example.

Two piezoelectric layers 32 corresponding to the two rows of pressure chambers 26 are arranged on top of the lower electrode 31. Each piezoelectric layer 32 has a rectangular planar shape that is elongated in the nozzle alignment direction and is arranged to span across the plurality of pressure chambers 26 constituting the corresponding single pressure chamber row. For example, the piezoelectric layer 32 is configured of a piezoelectric material whose primary component is lead zirconate titanate (PZT), which consists of mixed crystals of lead zirconate and lead titanate.

A plurality of the upper electrodes 33 corresponding to the pressure chambers 26 is formed on the top surfaces of the piezoelectric layers 32. The upper electrodes 33 are formed of platinum (Pt) or iridium (Ir), for example.

With the above configuration of the first embodiment, a single piezoelectric element 39 is configured of a single upper electrode 33, the portion of the common lower electrode 31 corresponding to a single pressure chamber 26, and the portion of a piezoelectric layer 32 corresponding to the single pressure chamber 26. Hereinafter, the portion of the piezoelectric layer 32 that is interposed between the upper electrode 33 and the lower electrode 31 of a piezoelectric element 39 will be called the active region 38 of the piezoelectric element 39.

An interconnect 35 is connected to the upper electrode 33 of each piezoelectric element 39. The interconnects 35 are formed of aluminum (Al) or gold (Au), for example. Each interconnect 35 extends upstream in the conveying direction (rearward) from the upper electrode 33 of the corresponding piezoelectric element 39. A plurality of drive contact parts 46 respectively connected to corresponding interconnects 35 and two ground contact parts 47 connected to the lower electrode 31 are arranged on the top surface of the channel substrate 20 on the exposed rear edge thereof, i.e., on the edge of the channel substrate 20 that is not covered by the cover member 23 described later.

The COF 50 constituting an interconnection member is bonded to the top surface of the channel substrate 20 on the rear edge thereof. A plurality of interconnects 55 is formed on the COF 50. The drive contact parts 46 on the channel substrate 20 side are electrically connected to corresponding interconnects 55. Ground interconnects (not shown) are also formed on the COF 50. The two ground contact parts 47 on the channel substrate 20 side are electrically connected to the ground interconnects on the COF 50.

Figure 7:
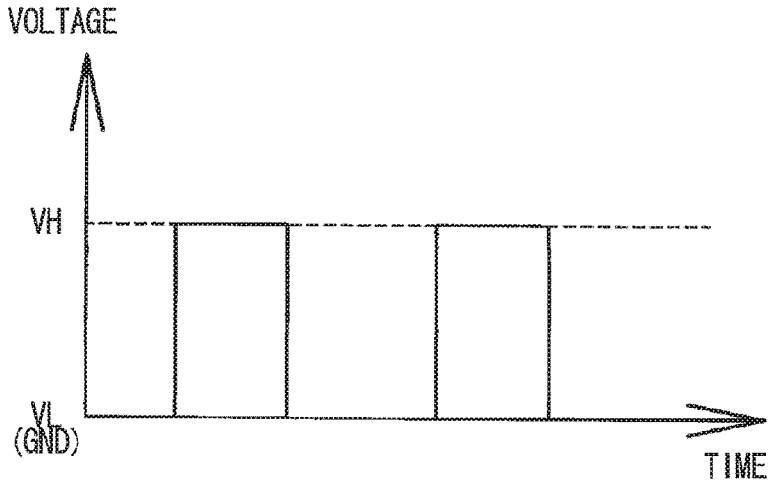
FIG. 7 is a graph showing an example of a shape of drive signal waveform.

A driver IC 51 is mounted on the COF 50. The COF 50 is connected to the controller 7 of the printer 1 (see FIG. 1). The driver IC 51 of each head unit 11 is electrically connected to the controller 7 through an interconnect 55 on the COF 50 (see FIG. 8). The driver IC 51 of each head unit 11 generates and outputs a drive signal for driving the piezoelectric elements 39 on the basis of a control signal received from the controller 7. While there is no particular restriction on the shape of the drive signal waveform, the signal may be shaped as a rectangular pulse that switches voltage between a low potential (ground potential: VL) and a high potential (VH), as shown in FIG. 7. The drive signal outputted from the driver IC 51 is inputted into the corresponding drive contact part 46 via the corresponding interconnect 55 of the COF 50 and is further supplied to the upper electrode 33 of the corresponding piezoelectric element 39 via the corresponding interconnect 35. Note that the lower electrode 31 is connected to a ground interconnect of the COF 50 via the ground contact part 47 so that the potential of the lower electrode 31 is constantly maintained at ground potential.

When a drive signal is supplied to the upper electrode 33 of the piezoelectric element 39, the potential of the upper electrode 33 changes relative to the ground potential according to the signal waveform. Consequently, a potential difference is produced between the upper electrode 33 and lower electrode 31, applying a drive voltage to the active region 38. Further an electric field parallel to the thickness direction of the piezoelectric element 39 is applied to the active region 38, causing the active region 38 to expand in its thickness direction and shrink along the direction of its surface. When the diaphragm 30 deflects to form a convex shape on the pressure chamber 26 side in response to the deformation of the active region 38, a pressure wave is produced in the pressure chamber 26, causing an ink droplet to be ejected from the nozzle 24 that is in communication with the pressure chamber 26.

Here, the driver IC 51 is able to modify the drive voltages applied to piezoelectric elements 39 of the corresponding head unit 11 based on commands from the controller 7. That is, the driver IC 51 can modify the high potential level (VH) in the example of FIG. 7. The method of modifying the drive voltage will be described later.

Cover Member

The cover member 23 is disposed on the top surface of the channel substrate 20 for covering the plurality of piezoelectric elements 39 in the piezoelectric actuator 22. As shown in FIG. 6, a pair of front and rear covering parts 54 is formed in the lower half portion of the cover member 23. The cover member 23 is bonded to the top surface of the diaphragm 30 formed over the channel substrate 20, with the two front and rear covering parts 54 covering the two front and rear piezoelectric layers 32.

An ink storage section 52 is formed in the upper half of the cover member 23 and is elongated in the nozzle alignment direction (the direction orthogonal to the paper surface of FIG. 6). The ink storage section 52 is in communication with the reservoir 12 of the inkjet head 4 (see FIG. 2). A plurality of ink supply channels 53 in communication with the ink storage section 52 is formed between the two covering parts 54 of the cover member 23. Each ink supply channel 53 also communicates with a corresponding pressure chamber 26 of the channel substrate 20 via a corresponding through-hole 30*a* formed in the diaphragm 30. With this configuration, ink in the ink storage section 52 is supplied to the plurality of pressure chambers 26 via the ink supply channels 53.

Owing to manufacturing tolerances and other factors, the ejection performance (ejection quantity and velocity) of nozzles 24 may vary among the plurality of head units 11 described above. For example, the piezoelectric elements 39 of head units 11 may have differing capacitances and resonant frequencies due to variations in the thickness of the piezoelectric layers 32 provided in different head units 11. When the properties of the piezoelectric elements 39 differ, the corresponding active regions 38 may deform by different amounts when the same drive voltage is applied to the piezoelectric elements 39. Such variations in deformation of the active regions 38 cause irregularities in the amount of energy applied to ink in the corresponding pressure chambers 26 among the plurality of head units 11, producing differences in the volume and velocity of ink ejected from the corresponding nozzles 24. Such differences may also be caused by different channel characteristics among the head units 11. That is, differences in the shape of ink channels formed in the nozzles 24 and pressure chambers 26 among the head units 11 can produce differences in channel resistance, which may affect ejection volume and velocity.

Variation in the quantity of ink ejected from nozzles 24 between different head units 11 produces variation in the size of dots formed on the sheets 100. Similarly, variation in the velocity of ink droplets ejected from the nozzles 24 results in variation in ink impact positions on the sheets 100. All of these variations cause a drop in image quality. In order to suppress variations in ejection volume and velocity among head units 11 with differing ejection properties, the drive voltages applied to piezoelectric elements 39 must be set lower in head units 11 with better performance than those in head units 11 with worse performance.

However, the piezoelectric property of the piezoelectric elements 39 gradually deteriorates as drive voltages are repeatedly applied to the piezoelectric elements 39, leading to a gradual decline in the performance of the piezoelectric elements 39. Such deterioration is accelerated when higher voltages or a larger number of voltages are applied to the piezoelectric elements 39. Hence, if there is a large difference in usage frequency among head units 11, the piezoelectric elements 39 in head units 11 used with higher frequency are more likely to deteriorate quicker, particularly when high drive voltages are applied to these head units 11. Therefore, head units 11 exhibiting a higher performance (requiring lower drive voltage) are allocated as head units 11 expected to have a high frequency of use in order to suppress degradation of the piezoelectric elements 39.

Ranking Head Units and Configuring Drive Voltages

As shown in FIG. 3, the nine head units 11 in the inkjet head 4 according to the first embodiment are juxtaposed in the nozzle alignment direction corresponding to the width direction of the sheet 100. Ranks are also assigned to each of the nine head units 11 based on their differences in ejection performance. For the convenience of this description, the rank for a high ejection performance will be called an A rank, while the rank for a low ejection performance will be called a B rank.

Figure 8:
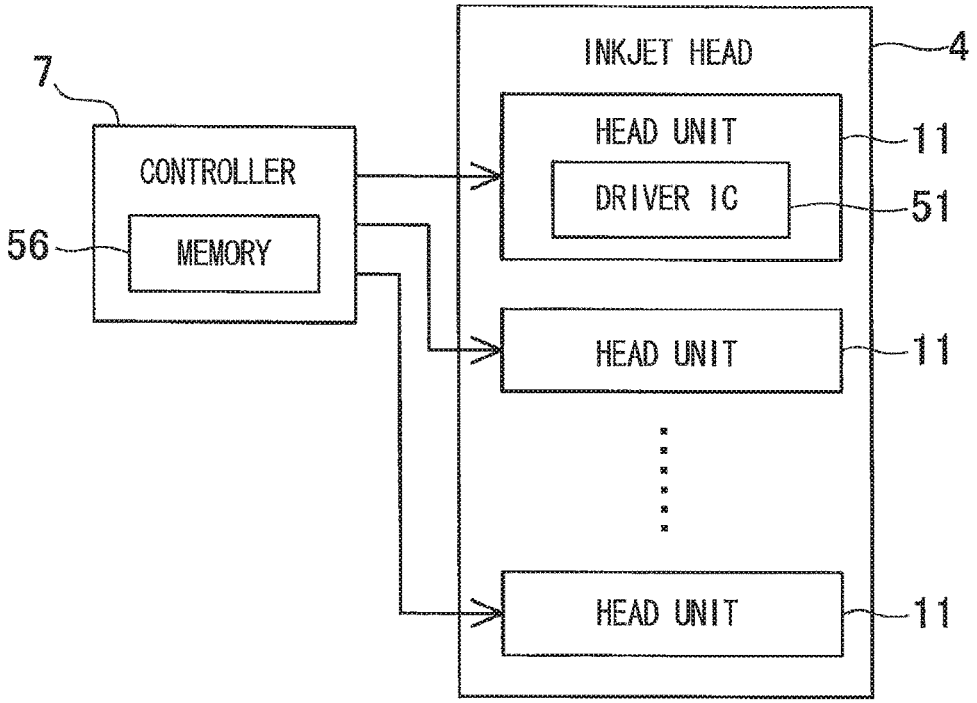
FIG. 8 is a block diagram showing a controller and an inkjet head of the printer according to the first embodiment.

As shown in FIG. 8, the controller 7 is provided with a nonvolatile memory 56. Information related to the ejection performance of each head unit 11 is stored in the memory 56 when the printer 1 is shipped from the factory. Specifically, this information indicates whether each head unit 11 belongs to the A rank or the B rank.

As will be described later, the head units 11 are ranked by measuring the properties of each head unit 11 related to ejection performance prior to assembling the head units 11 in the inkjet head 4. The properties of a head unit 11 related to ejection performance may include the capacitance and resonant frequency of the piezoelectric elements 39. When the piezoelectric elements 39 have a greater capacitance, a larger electric field can be applied to the piezoelectric layers 32 in order to produce greater deformation in the active regions 38 at the same drive voltage. Thus, a high capacitance of the piezoelectric elements 39 is treated as a high ejection performance of the nozzles 24.

Further, the driver IC 51 of each head unit 11 has an internal rectifier circuit for setting the drive voltage outputted to piezoelectric elements 39 (the high potential level VH in FIG. 7). As shown in FIG. 8, the driver IC 51 of each head unit 11 generates a drive voltage based on information transmitted from the controller 7 related to the ejection performance of the head unit 11 and outputs the drive voltage to the piezoelectric elements 39. That is, based on the factory settings of the printer 1 prior to shipping, the driver IC 51 of an A rank head unit 11A outputs a drive voltage Va1 that is lower than the drive voltage Vb1 outputted by the driver IC 51 of a B rank head unit 11B.

As an example, head units 11 whose piezoelectric elements 39 have an average capacitance of 230 pF or greater are set to the A rank, while head units 11 whose piezoelectric elements 39 have a capacitance below 230 pF are set to the B rank. Subsequently, the drive voltage Va1 used in A rank head units 11A is set to 19 V, and the drive voltage Vb1 used in B rank head units 11B is set to 25 V.

Figure 9A:
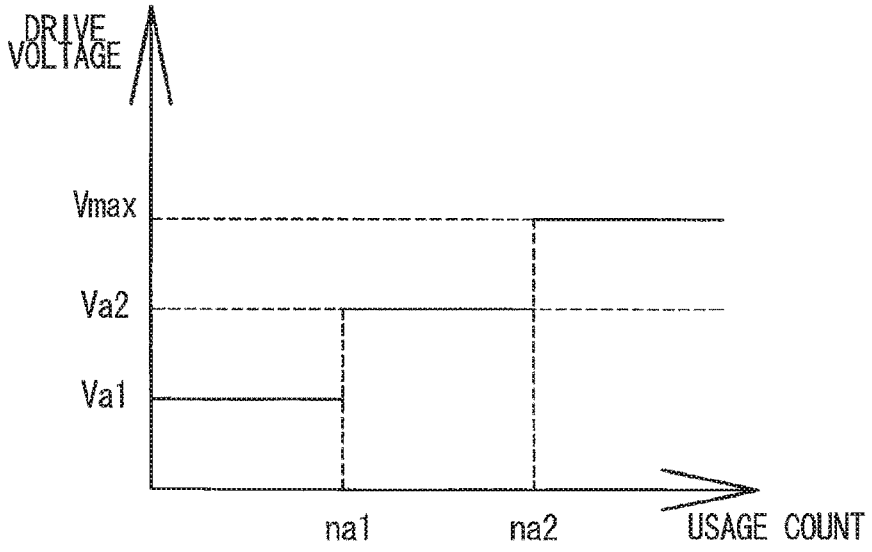
FIGS. 9A and 9B are explanatory diagrams illustrating change in drive voltages based on the number of times that each of head units has been used.
Figure 9B:
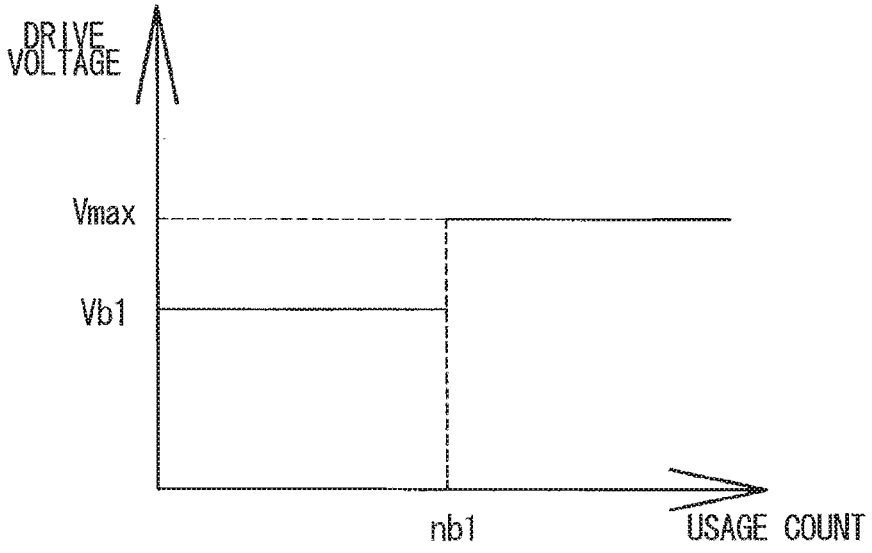

After drive voltages have been repeatedly applied to the piezoelectric elements 39, the performance of the piezoelectric elements 39 inevitably degrades. To compensate for this degradation in performance, the driver IC 51 of each head unit 11 increases the drive voltage applied to the piezoelectric elements 39 on the basis of the number of times that the head unit 11 has been used, as illustrated in FIGS. 9A and 9B. By increasing the drive voltage applied to piezoelectric elements 39 whose deformation has decreased due to degradation in performance, the driver IC 51 can return the deformation amount of the piezoelectric elements 39 to the initial level when the product was first shipped.

More specifically, information related to the usage count of each head unit 11 is stored in the memory 56 of the controller 7. Information related to the usage count of a head unit 11 may be data used commonly for all head units 11, such as data indicating the number of sheets 100 that have been printed. Alternatively, the controller 7 may count the number of times the nozzles 24 of each head unit 11 have ejected ink (the number of times each piezoelectric element 39 has been driven) and may use this ejection count as the information related to the usage count of the respective head unit 11.

The driver IC 51 of each head unit 11 references the information stored in the memory 56 and increases the drive voltage based on the usage count. As shown in FIG. 9A, the driver IC 51 of an A rank head unit 11A increases the drive voltage from the initial value Va1 to a higher value Va2 when the usage count reaches the value na1, and further increases the drive voltage to the value Vmax when the usage count reaches the value na2. Here, the drive voltage Vmax is the maximum voltage that the driver IC 51 can output and may be equivalent to the power supply voltage for the printer 1, for example. In contrast, the driver IC 51 of a B rank head unit 11B increases the drive voltage from its initial value Vb1 to the value Vmax when the usage count reaches the value nb1, as shown in FIG. 9B.

Note that once the driver IC 51 has increased the drive voltage to Vmax, the drive voltage cannot be increased further, even when the piezoelectric element 39 continues to degrade thereafter. From another perspective, since the initial drive voltage used for an A rank head unit 11A is lower than that used for a B rank head unit 11B, there is a larger margin for increasing the drive voltage in the A rank head units 11A before reaching the maximum value Vmax.

Arrangement of Head Units Based on Usage Frequency

During typical printing on a printer, text, images, and the like are most frequently printed in the widthwise center region of sheets 100, with little printing performed in the edge regions. Thus, in a single inkjet head 4, a difference in usage frequency occurs between head units 11 that eject ink toward the widthwise center region of the sheet 100 (hereinafter called "center head units 11") and head units 11 that eject ink toward the edge regions (hereinafter called "edge head units 11"). Consequently, the piezoelectric elements 39 in center head units 11 are driven with greater frequency than piezoelectric elements 39 in edge head units 11, leading to more rapid deterioration in the piezoelectric elements 39 of center head units 11. In other words, the edge head units 11 are disposed in edge portions of the inkjet head 4 in the widthwise direction and the center head units 11 are disposed in the center portion between the end portions of the inkjet head 4 in the widthwise direction.

Therefore, A rank head units 11A are allocated as the center head units 11 having a high usage frequency, and a low drive voltage is applied to the piezoelectric elements 39 in the A rank head units 11A. On the other hand, B rank head units 11B are allocated as the edge head units 11 having a low usage frequency, and a high drive voltage is applied to the piezoelectric elements 39 in the B rank head units 11B.

In other words, B rank head units 11B exhibiting a lower ejection performance are arranged on the ends of the A rank head units 11A exhibiting a higher ejection performance relative to the nozzle alignment direction. More specifically, the nine head units 11 configuring a single inkjet head 4 include five A rank head units 11A and four B rank head units 11B. The five A rank head units 11A are arranged in the center portion with respect to the nozzle alignment direction. The four B rank head units 11B are arranged two each on the left and right sides of the five A rank head units 11A. That is, the B rank head units 11B having an ejection performance lower than that of the A rank head units 11A are farther from the center portion of the inkjet head 4 than the A rank head units 11A are.

Figure 10:
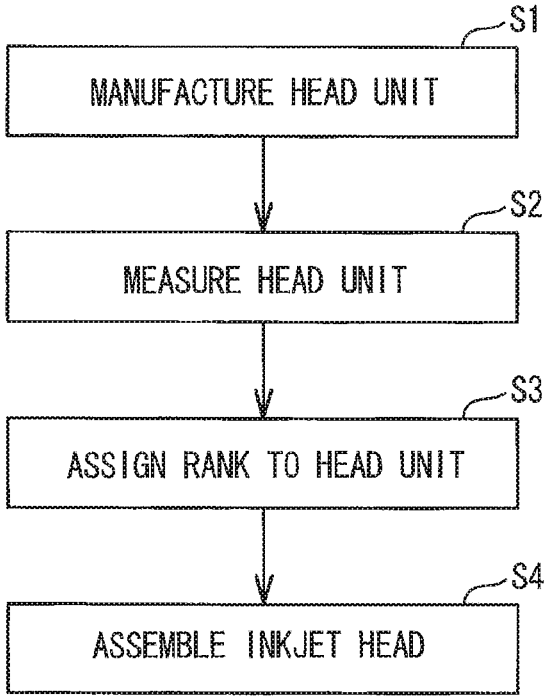
FIG. 10 is a flowchart illustrating steps in a process of manufacturing the inkjet head.

Next, the method of manufacturing the above inkjet head 4 will be described with reference to FIGS. 3 through 6 and the flowchart of FIG. 10.

Method of Manufacturing Head Units

The method of manufacturing the head unit 11 in S1 involves first forming the diaphragm 30 over the channel substrate 20, and subsequently forming the plurality of piezoelectric elements 39 by sequentially depositing a plurality of thin films on top of the diaphragm 30. Next, the pressure chambers 26 are formed in the channel substrate 20 by etching. Finally, the nozzle plate 21 in which the nozzles 24 are formed is bonded to the channel substrate 20.

Method of Measuring Properties of Head Units

Next, in S2, properties related to ejection performance of the nozzles 24 are measured for each head unit 11 manufactured according to the method described above. An example of a typical property that affects ejection performance is the capacitance of the piezoelectric elements 39. The capacitance of the piezoelectric elements 39 is measured based on changes in voltage or current when a prescribed voltage is applied to the piezoelectric elements 39. Since the piezoelectric elements 39 exhibit greater deformation at a low drive voltage when their capacitance is high, high capacitance can be equated to high performance. Alternatively, the resonant frequency of the piezoelectric element 39 may be measured instead of capacitance. The rigidity of a piezoelectric element 39 varies according to the thickness of the piezoelectric layer 32. A piezoelectric element 39 with higher rigidity is less prone to deformation. Rigidity of the piezoelectric element 39 can be understood by measuring resonant frequency.

Channel resistance also greatly influences ejection performance. Therefore, the shape of the ink channels, such as the hole diameters of the nozzles 24, may be measured. The behavior of ink may also be analyzed by actually driving the piezoelectric elements 39 in order to exert energy on the ink in the pressure chambers 26. For example, the ink droplet quantity and velocity may be measured by capturing images of the ink droplets as they are ejected from the nozzles 24. Alternatively, pressure changes in ink accommodated in the pressure chambers 26 may be measured when the piezoelectric elements 39 are driven.

Method of Assigning Ranks to Head Units

After the ejection performance of each head unit 11 has been measured, a rank is assigned to the head unit 11 by comparing its performance to a prescribed threshold value in S3. A head unit 11 with superior ejection performance is given an A rank, while a head unit 11 with inferior ejection performance is given a B rank.

Method of Assembling Inkjet Head

Next, in S4, an inkjet head 4 is assembled in the corresponding holder 10 by juxtaposing the nine head units 11 along the longitudinal dimension of the holder 10. At this time, A rank head units 11A are arranged in the center portion with respect to the nozzle alignment direction (along the longitudinal dimension of the holder 10), while B rank head units 11B are arranged on both ends of the A rank head units 11A in the nozzle alignment direction, as illustrated in FIG. 3.

In the inkjet head 4 of the first embodiment described above, the A rank head units 11A exhibiting a higher ejection performance are arranged in center positions of the inkjet head 4 where usage frequency is higher, while the B rank head units 11B exhibiting a lower ejection performance are arranged at edge positions where usage frequency is lower. By setting the drive voltage applied to the piezoelectric elements 39 in the A rank head units 11A lower than that applied to piezoelectric elements 39 in the B rank head units 11B, it is possible to suppress degradation of piezoelectric elements 39 that see higher frequency of use.

The first embodiment uses a combination of head units 11 exhibiting differing ejection performance. Accordingly, head units 11 that could not be used in conventional devices due to their lower performance can be used in the printer 1 of the first embodiment by arranging the head units 11 at edge positions in the nozzle alignment direction, thereby improving the yield for head units.

The driver IC 51 of each head unit 11 increases the drive voltage applied to the piezoelectric elements 39 based on the usage count. Thus, even though piezoelectric elements 39 in A rank head units 11A having a higher frequency of use degrade at a faster rate, the driver ICs 51 apply a lower initial drive voltage to the A rank head units 11A than to the B rank head units 11B, thereby providing a greater margin for increasing the voltage in order to compensate for such degradation. Accordingly, this configuration can mitigate the condition in which piezoelectric elements 39 of the A rank head units 11A become unusable at a quicker rate than the B rank head units 11B, thereby extending the product life.

The sheet 100 serves an example of a recording medium. The conveying rollers 5 and 6 serve as an example of a conveying unit. The driver IC 51 serves as an example of a drive unit. Each A rank head unit serves as an example of a first head unit. Each B rank head unit serves as an example of a second head unit. Each piezoelectric element 39 serves as an example of a drive element. The nonvolatile memory 56 serves as an example of a storage device.

Next, variations of the first embodiment described above including various modifications will be described, wherein like parts and components are designated with the same reference numerals to avoid duplicating description.

Figure 11:
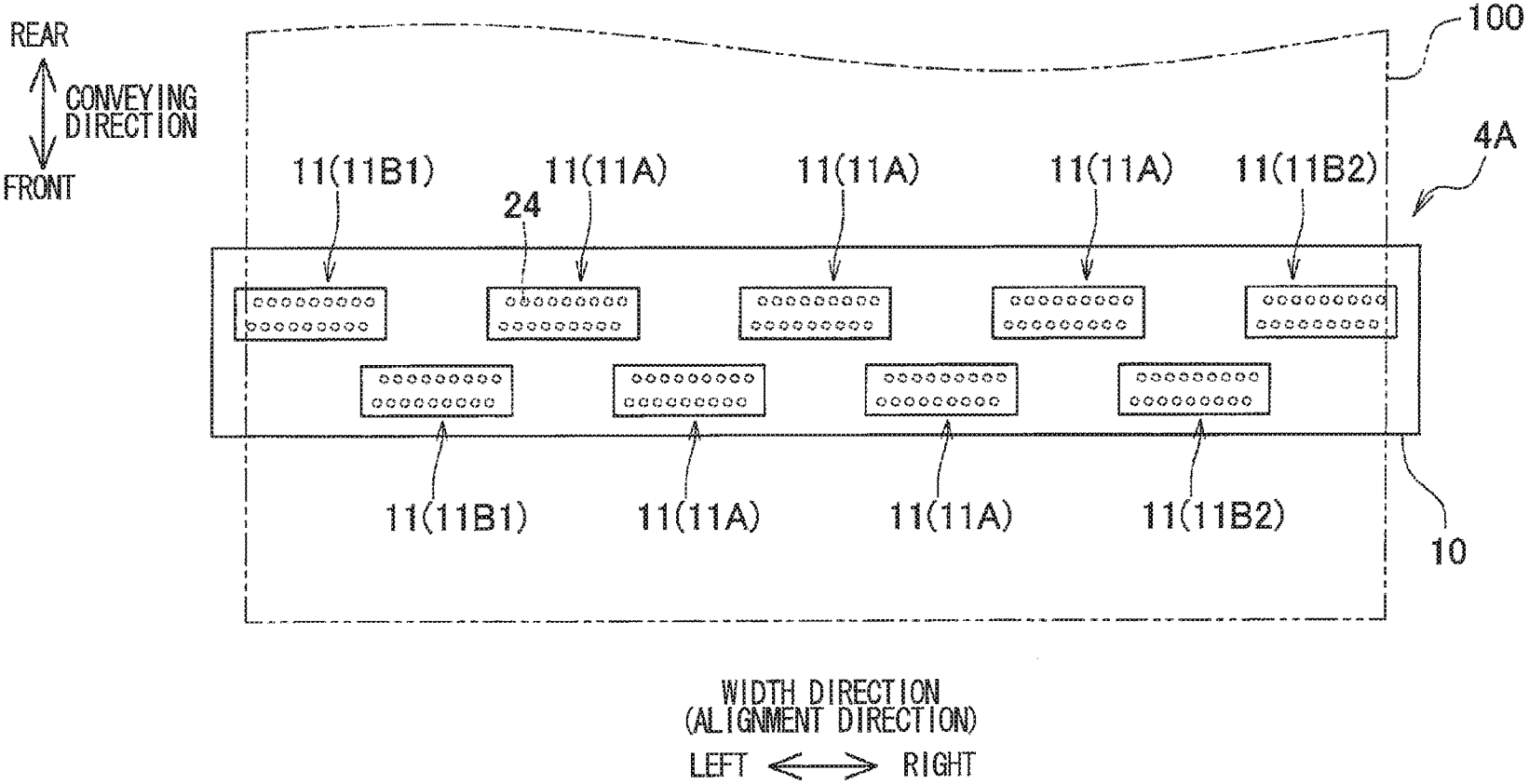
FIG. 11 is a plan view of an inkjet head of a printer according to a modification of the first embodiment.

(1) In an inkjet head 4A shown in FIG. 11, the head units 11 arranged on the left and right sides of the A rank head units 11A (11B1, 11B2) have a different ejection performance. This arrangement is effective when the usage frequency of head units 11 differs not only between the center portion and the end portions of the inkjet head 4, but also between the left end portion and the right end portion.

Here, the B rank head units 11B described above in the first embodiment are further divided into two ranks based on the ejection performance of their nozzles 24. For convenience of description, B1 will denote the rank with higher ejection performance, while B2 will denote the rank with lower ejection performance. The head units 11B1 having the higher B1 rank are arranged on the side relative to the nozzle alignment direction (left side or right side) expected to have a higher frequency of use, while head units 11B2 having the lower B2 rank are arranged on the side expected to have a lower frequency of use. Here, the driver IC in a B1 rank head unit 11B1 applies a lower drive voltage to the piezoelectric elements than the driver IC in a B2 rank head unit 11B2. In other words, the driver IC in the B2 rank head unit 11B2 applies a drive voltage to the piezoelectric elements higher than that the driver IC in the B1 rank head unit 11B1.

This is particularly effective when printing text horizontally on the sheets 100, as such text is generally left-justified. That is, from the perspective of a user facing the front of the printer (the downstream side in the conveying direction), a greater amount of printing is performed on the left-side portion of the sheet 100 being conveyed toward the user than on the right-side portion. Therefore, the usage frequency of a left head unit 11 will be higher than that of a right head unit 11. Accordingly, when viewing the printer 1 from the downstream side in the conveying direction, the B1 rank head units 11B1 exhibiting a relatively high performance are arranged on the left side of the A rank head units 11A, while the B2 rank head units 11B2 exhibiting a relatively low performance are arranged on the right side of the A rank head units 11A. In this case, each B1 rank head unit serves as an example of a second head unit and each B2 rank head unit serves an example of a third head unit.

(2) While the plurality of head units 11 is divided into two ranks (the A rank and B rank) in the first embodiment described above, the head units may be classified under three or more ranks instead. In this case, head units 11 having a lower rank (a lower performance) are arranged closer to the ends in the nozzle alignment direction.

(3) In the first embodiment described above, each head unit 11 individually possesses a channel member (the channel substrate 20 and nozzle plate 21) in which are formed ink channels, and a piezoelectric actuator 22 provided on the channel member. However, the channel member may be shared by a plurality of the head units while each head unit individually possesses a piezoelectric actuator.

(4) In the first embodiment described above, each head unit 11 is individually provided with a driver IC 51 (serving as an example of a drive unit) for applying a drive voltage to the piezoelectric elements 39. However, a single drive unit that applies drive voltages to the piezoelectric elements 39 may be provided commonly for a plurality of head units 11.

(5) The driving elements that function to eject ink from nozzles are not limited to the piezoelectric elements described in the first embodiment. For example, the driving elements may be configured of heating elements that heat ink to cause film boiling.

Second Embodiment

Figure 12:
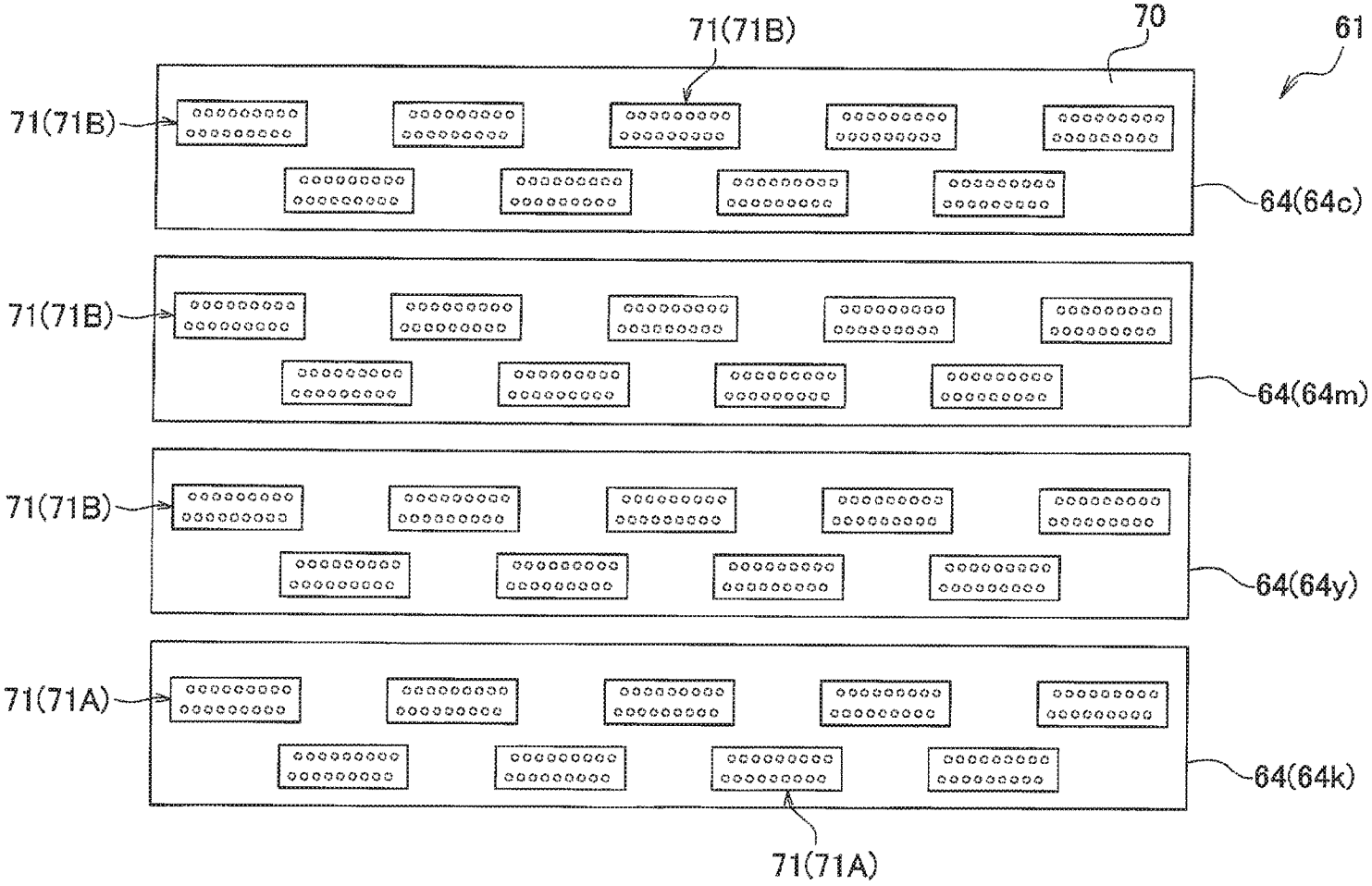
FIG. 12 is a plan view of an inkjet head of a printer according to a second embodiment.

Next, a printer 61 according to a second embodiment will be described. The printer 61 according to the second embodiment has the same overall structure as the printer 1 in the first embodiment described above. As shown in FIG. 12, the printer 61 has four inkjet heads 64 juxtaposed in the conveying direction of the sheet 100. The four inkjet heads 64 (64*c*, 64*m*, 64*y*, and 64*k*) are configured to eject ink in the four colors cyan, magenta, yellow, and black, respectively. Each inkjet head 64 includes a plurality of holder 70 and head units 71. Each holder 70 extends in a width dimension of the sheet. The head units 71 (nine head units 71) are provided on each of the plurality of holders and aligned in a direction of nozzle alignment corresponding to the width dimension of the sheet.

The head units 71 have the same structure as the head units 11 described in the first embodiment and, therefore, a description of this structure will not be repeated. Further, ejection performance is also measured to assign a rank to each head unit 71, as in the first embodiment. However, the method of arranging the head units 71 by rank differs from that in the first embodiment.

In the second embodiment, all head units 71 in some of the inkjet heads 64 (64*k*) are A rank head units 71A, while all head units 71 in the remaining inkjet heads 64 (64*c*, 64*m*, and 64*y*) are B rank head units 71B. Here, the driver ICs in the A rank head units 71A apply a lower drive voltage to the piezoelectric elements than the driver ICs in the B rank head units 71B. This configuration is effective when the frequency of use differs among inkjet heads 64 that eject different types of ink.

Particularly, in color inkjet printers that use a plurality of ink colors, black ink used for printing text has a considerably higher frequency of use than color ink used for printing images and the like. Therefore, A rank head units 71A are used in the inkjet head 64*k* that ejects black ink, while B rank head units 71B are used in the three inkjet heads 64*c*, 64*m*, and 64*y* that eject colored ink. In this way, the drive voltage applied to piezoelectric elements in the head units 71 is lower for head units 71 in the inkjet head 64*k* having a higher frequency of use, thereby suppressing degradation in performance of these piezoelectric elements caused by the repeated application of voltage.

Further, the method of manufacturing the inkjet heads 64 (64*c*, 64*m*, 64*y*, and 64*k*) will be described. The inkjet heads 64 are manufactured in a similar manner to that shown in FIG. 10 according to the first embodiment. The processes of S1 to S3 are the same as that in the first embodiment. In S4 of the second embodiment, the inkjet head 64*k* is assembled in the corresponding holder 10 by juxtaposing the nine A rank head units 11A along the longitudinal dimension of the holder 10, while each of the inkjet head 64*c*, 64*m*, 64*y* is manufactured by juxtaposing the nine B rank head units 11B, as illustrated in FIG. 12.

The black ink serves as an example of first ink. Each of cyan, magenta, yellow inks serves as an example of second ink. The inkjet head 64*k* serves as an example of a first inkjet head. Each of the inkjet heads 64*c*, 64*m*, and 64*y* serves as an example of a second inkjet head.

Note that usage of the A rank head units 71A is not restricted to the inkjet head 64*k* for black ink. For example, in a printer that prints using special ink, such as white ink, the inkjet head that ejects the special ink may have the highest frequency of use. In this case, the A rank head units 71A may be used in the inkjet head 64 that ejects the special ink.

What is claimed is:

1. A printer comprising:

a conveying unit configured to convey a recording medium in a conveying direction;

an inkjet head including a plurality of head units arranged in an alignment direction crossing the conveying direction, the inkjet head having end portions and a center portion between the end portions in the alignment direction, each of the plurality of head units having a plurality of nozzles and a plurality of drive elements, the plurality of nozzles and the plurality of drive elements having a one-to-one correspondence, each of the plurality of drive elements being configured to apply ejecting energy to ink to eject an ink droplet through a corresponding one of the plurality of nozzles, the plurality of head units including a first head unit and a second head unit, the second head unit having an ejection performance of nozzles lower than an ejection performance of nozzles of the first head unit, wherein the second head unit is farther from the center portion than the first head unit; and a drive unit configured to apply a drive voltage for generating the ejecting energy to each of the plurality of drive elements included in each of the plurality of head units, wherein the drive voltage applied to each of the plurality of drive elements included in the first head unit is lower than the drive voltage applied to each of the plurality of drive elements included in the second head unit.

2. The printer according to claim 1, wherein the plurality of head units further includes a third head unit having an ejection performance of nozzles lower than the ejection performance of nozzles of the second head unit, the third head unit being farther from the center portion than the first head unit, the first head unit being disposed between the second head unit and the third head unit, and wherein the drive voltage applied to each of the plurality of drive elements included in the third head unit is higher than the drive voltage applied to each of the plurality of drive elements included in the second head unit.

3. The printer according to claim 2, wherein the second head unit is disposed on a left end portion of the inkjet head viewed from a downstream side in the conveying direction, and the third head unit is disposed on a right end portion of the inkjet head viewed from the downstream side in the conveying direction.

4. The printer according to claim 1, wherein each of the plurality of drive elements comprises a piezoelectric element including:

a first electrode;

a second electrode; and a piezoelectric film interposed between the first electrode and the second electrode.

5. The printer according to claim 4, wherein the piezoelectric element of the first head unit has a capacitance greater than a capacitance of the piezoelectric element of the second head unit.

6. The printer according to claim 1, further comprising a storage device storing information related to a number of times that each of the plurality of head units has been used, wherein the drive unit is configured to increase the drive voltage applied to each of the plurality of drive elements included in the each of the plurality of head units on a basis of the information related to a number of times that the each of the plurality of head units has been used.

7. A printer comprising:

a conveying unit configured to convey a recording medium in a conveying direction;

a first inkjet head configured to eject first ink on the recording medium;

a second inkjet head configured to eject second ink on the recording medium, the first inkjet head and the second inkjet head being arranged in the conveying direction, each of the first inkjet head and the second inkjet head having a plurality of head units arranged in an alignment direction crossing the conveying direction, each of the plurality of head units having a plurality of nozzles and a plurality of drive elements, the plurality of nozzles and the plurality of drive elements having a one-to-one correspondence, each of the plurality of drive elements being configured to apply ejecting energy to ink to eject an ink droplet from a corresponding one of the plurality of nozzles, each of the plurality of head units of the second inkjet head having an ejection performance of nozzles lower than an ejection performance of nozzles of each of the plurality of head units of the first inkjet head; and a drive unit configured to apply a drive voltage for generating the ejecting energy to each of the plurality of drive elements included in each of the plurality of head units, wherein the drive voltage applied to each of the plurality of drive elements included in each of the plurality of head units of the first inkjet head is lower than the drive voltage applied to each of the plurality of drive elements included in each of the plurality of head units of the second inkjet head.

8. The printer according to claim 7, wherein the first ink is black ink.

9. A method of manufacturing a printer comprising:

manufacturing a plurality of head units each having a plurality of nozzles and a plurality of drive elements, the plurality of nozzles and the plurality of drive elements having a one-to-one correspondence, each of the plurality of drive elements being configured to apply ejecting energy to ink to eject an ink droplet from a corresponding one of the plurality of nozzles;

measuring an ejection performance of nozzles of each of the plurality of head units; and assembling an inkjet head by arranging the plurality of head units in a predetermined direction, the plurality of head units including a first head unit and a second head unit, the second head unit having an ejection performance of nozzles lower than an ejection performance of nozzles of the first head unit, wherein the second head unit is farther from a center portion of the inkjet head than the first head unit.

10. A method of manufacturing a printer comprising:

manufacturing a plurality of head units each having a plurality of nozzles and a plurality of drive elements, the plurality of nozzles and the plurality of drive elements having a one-to-one correspondence, each of the plurality of drive elements being configured to apply ejecting energy to ink to eject an ink droplet from a corresponding one of the plurality of nozzles;

measuring an ejection performance of nozzles of each of the plurality of head units; and assembling a first inkjet head configured to eject first ink and a second inkjet head configured to eject second ink, the first inkjet head being assembled by arranging first head units of the plurality of head units in a predetermined direction, the second inkjet head being assembled by arranging second head units of the plurality of head units in the predetermined direction, each of the second head units having an ejection performance of nozzles lower than an ejection performance of nozzles of each of the first head units.

* * * * *